United States Patent [19]

Stern

[11] 4,389,650

[45] Jun. 21, 1983

[54] LINE SOURCE ANTENNA FOR ELECTRONIC BEAM SCANNING

[75] Inventor: Richard A. Stern, Allenwood, N.J.

[73] Assignee: The United States of America as represented by the Secretary of the Army, Washington, D.C.

[21] Appl. No.: 205,361

[22] Filed: Nov. 10, 1980

[51] Int. Cl.[3] ..... H01Q 13/10

[52] U.S. Cl. ..... 343/768

[58] Field of Search ..... 343/768, 771, 854, 787

[56] References Cited

U.S. PATENT DOCUMENTS

| | | | |
|---|---|---|---|
| 2,808,584 | 10/1957 | Kock | 343/768 |
| 3,212,031 | 10/1965 | Reggia et al. | 343/854 |
| 4,092,647 | 5/1978 | Borowick et al. | 343/768 |

OTHER PUBLICATIONS

Babbitt et al.; Phase Control Elements for Millimeter Wave Systems; ACARD Conf. Proc. No. 245, Munich, Germany; Sep. 1978.

*Primary Examiner*—Eli Lieberman

*Attorney, Agent, or Firm*—Nathan Edelberg; Jeremiah G. Murray; Edward P. Griffin, Jr.

[57] ABSTRACT

A line source antenna adapted for a light weight, compact phased array radar and consisting of a plurality of radiating slots periodically located in one side wall of a length of waveguide, having a single monolithic ferrite phase shifter in the form of a long continuous toroid extending the length of all of the slots.

13 Claims, 5 Drawing Figures

LINE SOURCE ANTENNA FOR ELECTRONIC BEAM SCANNING

The invention described herein may be manufactured and used by or for the Government for governmental purposes without the payment of any royalties thereon or therefor.

BACKGROUND OF THE INVENTION

This invention relates to phase-scanned radar antenna arrays or radiating phase shifters of the slot type, with periodic control of slot or coupling, and more particularly to a line source array in which the beam may be electronically scanned over a limited angular range.

Small angle electronic scanning of a radar beam is required in many surveillance applications. Such antennas have been developed by Rockwell International as described for example in an article entitled "Inexpensive Phased Array Opens Up New Radar Applications", by Richard T. Davis in *Microwaves,* August 1975 at pages 15 and 16. The phased array antenna disclosed therein is based on a series ferrite scan principle in which a waveguide having series connected ferrite phase shifters inserted lengthwise between each radiating element has current applied which induces a longitudinal magnetic field in the ferrite. Electronic beam scanning is effected by controlling the propagating velocity or phase shift per unit length of the ferrite loaded waveguide. See also U.S. Pat. No. 3,855,597 by R. L. Carlise for a Phase-Scanned Radiating Array.

Also of interest are two articles in *Microwaves,* "Beam Pointing Direction of Travelling Wave Arrays", June 1969, pages 76 et seq.; and "A Single Bit Latching Reciprocal Ferrite Phase Shifter", March 1970, pages 46 et seq.

An improved Line Source Antenna for Small Angle Electronic Beam Scanning is described in U.S. Pat. No. 4,092,647 by J. J. Borowick, B. Gelernler, N. Lipetz and R. A. Stern. It covers a line source antenna comprising a plurality of side wall, shunt slot radiatiors in a waveguide section with a non-reciprocal latching phase shifter with matching transformers located between pairs of slots. Change of the insertion phase between adjacent slots is provided by a switching wire element running centrally through the phase shifters and matching transformers along the central axis of the waveguide. A common electronic driver is coupled to a respective switching wire element to energize (latch) a selected number of the ferrite elements which are operated in sets. While this line source antenna is an improvement, in a particular example it has 14 phase shifters, each with a pair of dielectric matching transformers, resulting in 42 parts and pieces of ferrite and dielectric being fabricated and installed therein. The active ferrites in this structure encompass only a fraction of the length of the line source, thereby resulting in less than optimum efficiency.

SUMMARY OF THE INVENTION

The object of the invention is to provide a phased array antenna which is more efficient, simplified, and less costly.

The antenna according to the invention utilizes a single long continuous toroid to replace the plurality of individual ferrites, thereby also utilizing only two impedance matching transformers. Simplified design, fabrication, and reduced cost results. The active ferrite region between adjacent slots is increased due to elimination of transformers and air gaps resulting in greatly improved antenna efficiency. This major design improvement lends itself to millimeter wave antenna design particularly well where small size dictates the need for simplified design in order to feasibly fabricate such units and reduce labor costs.

Thus, the feature of this invention is a cost effective monolithic design structure which also incorporates more active ferrite material thereby increasing scan capability.

BRIEF DESCRIPTION OF THE DRAWING

In FIGS. 3 and 5 in particular, the thickness of the outer metal part is shown exagerated for convenience of drawing.

DETAILED DESCRIPTION

The basic principles and operation of the monolithic line source antenna array with radiating slots, as covered by this application, are the same as described in U.S. Pat. No. 4,092,647, which is incorporated by reference. Structural differences are described below.

Figure 1:
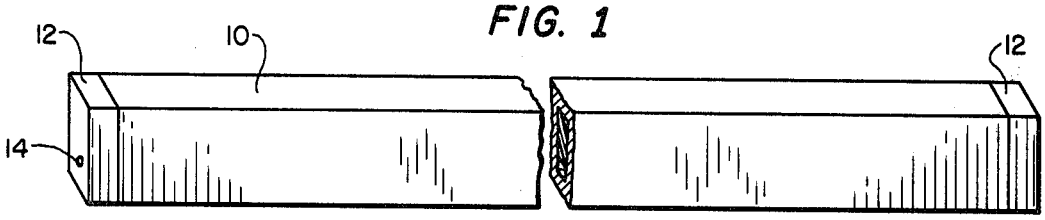
FIG. 1 is an oblique view of a ferrite phase shift element with matching transformers.
Figure 2:
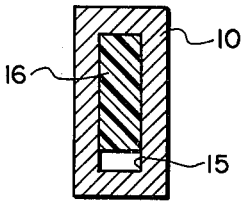
FIG. 2 is a cross-section view of FIG. 1.

The principal change is that in place of a separate ferrite phase shifter in each cell between adjacent slots, a single long ferrite toroid is utilized for all of the cells and slots. In FIG. 1 is shown a ferrite phase shift element with matching transformers. It comprises the ferrite toroid 10 and two dielectric matching transformers 12 at the ends. A hole 14 is provided for the switching wire. A cross-sectional view of the toroid is shown in FIG. 2. The inside of the toroid 10 is filled with a dielectric material 16.

Figure 3:
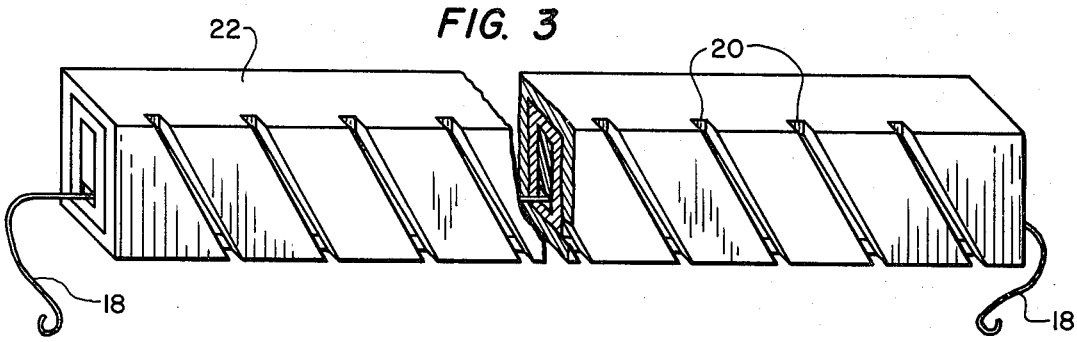
FIG. 3 is an oblique view of a monolithic line source array incorporating the ferrite element of FIG. 1.

FIG. 3 shows a monolithic line source antenna array having 15 radiating slots. It is formed by either enclosing the phase shift element of FIG. 1 in a close fitting waveguide housing, or alternatively by applying a metal coating to the phase shift element. The fifteen slots 20 are formed through the metal on one of the broad faces. The switching wire 18 extends through the hole of the toroid. The dielectric matching transformers 12 are not shown in FIG. 3.

Undesired mode suppression affects the size and shape of the ferrite and waveguide array. A filled waveguide causes reduced guide wavelength and antenna aperture and affects beamwidth. If the outer dimensions of the unloaded antenna are retained and continuous loading employed, mode problems and high side lobes may result. The subject monolithic line source antenna has been designed to suppress the high loss, undesirable modes, which affects the width and height of the ferrite and waveguide array. Specifically, the $LSE_{12}$, $LSE_{20}$, $LSE_{21}$, $LSM_{11}$, and $LSM_{12}$ modes are eliminated by reducing the height and width of the standard size waveguide (RG-96) normally used in the 26–40 GHz frequency region. The reduced cross-section of the ferrite loaded guide will not support those undesirable modes.

The cross-sectional dimensions arrived at for this structure were generated through a computer program designed to predict which particular TE and TM modes could exist in the subject cross-sectional design as a function of waveguide height, width, ferrite width, dielectric constant of ferrite, magnetization of ferrite and operating frequency. Through the use of this computer program, it was found that nearly all of the higher order modes could be suppressed by reducing the loaded waveguide height by approximately 30% and by reducing the waveguide width by at least 50%. Further reduction in waveguide width would also insure a more flat phase shift response as a function of frequency. The width of the ferrite is virtually unchanged when going to the new reduced width structure, but when reducing the waveguide height, the height of the ferrite is obviously reduced. This procedure of reducing the cross-section of a ferrite phase shifter is commonly done by those working in the area of non-reciprocal ferrite phase shifters. The views of FIGS. 4 and 5 compare the cross-section of a standard loaded waveguide (FIG. 4) to that of a reduced unit (FIG. 5).

Operating bandwidth of the reduced cross-section device has been shown to improve due to suppression of lossy moding spikes, while the phase shift is slightly reduced due to reduction of the ferrite toroid height.

The suppression of undesired modes is well known to those working in this particular technical field. Utilizing one long continuous ferrite toroid in a reduced height, reduced width, slotted antenna array is the heart of the subject invention.

Figure 5:
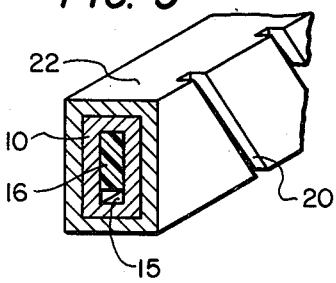
FIGS. 4 and 5 are cross-section oblique views comparing a standard size slotted waveguide unit with a reduced unit as used by the monolithic ferrite array.
Figure 4:
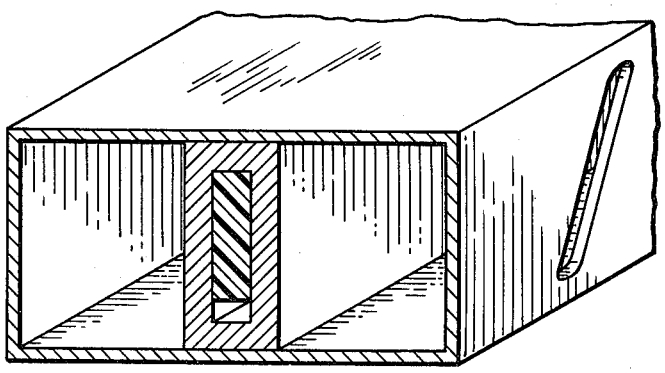

In the array configuration, we see that the reduced waveguide height will obviously result in a reduction of the height of the radiating slots as shown in the views of FIG. 4 (standard) and FIG. 5 (reduced). Although the slot becomes physically shorter, the slot will look electrically longer because in this new invention (as opposed to the prior patent design) the ferrite is loading the slot region, causing the slot to be electrically longer due to dielectric loading. The slot narrow width will have to be reduced since this dielectric loading will make the slot look electrically overly wide. The reduced width of the waveguide will not affect the basic antenna operation.

The filled waveguide also causes reduced guide wavelength. Thus the slot spacing (distance between adjacent slots) must be reduced to insure that the desired number of electrical degrees (~400°) is maintained between adjacent slots. In the design of the prior patent mentioned earlier, the slot spacing in that case was reduced relative to the slot spacing which would normally have been used in an air filled line source antenna array. Hence, the reduction of slot spacing in the new invention poses no significant problems in the design and operation of this proposed antenna array. The antenna is intended to function as a line source array with the reduced cross-section guide propagating the dominant $TE_{10}$ mode.

In one detailed design, the array consists of a metalized toroid formed by arc-plasma spray metalization or metalization by sputtering, which provides the metal coating. After metalization of the ferrite is complete, the slot array is formed by using photo-resist and masking techniques commonly used in integrated circuit and surface acoustic wave device fabrication. Waveguide transformer sections make the transition from standard RG-96 waveguide to the reduced cross-section, metalized ferrite guide. These matching transformers are not necessarily of the size and shape shown in FIG. 1.

As described in said prior patent, energization of the ferrite member 10 is achieved by means of the latching switching wire conductor 18 which runs through the dielectric loading element 16 within the ferrite 10 thereby inducing a magnetic field within the ferrite in a plane transverse to the wire conductor. A single driver circuit (not shown) is coupled to the switching conductor 18.

Incorporated by reference is a technical paper entitled "Millimeter Antenna Array for Limited Scan Applications" presented at a workshop at the International IEEE-MTT Microwave Symposium in May 1980. This paper details recent advances made in a line source array operating in the 32 GHz frequency region; the same frequency region in which the subject invention is being designed to operate. The paper shows that the prior patent design works successfully at 32 GHz. Effort on the subject invention was also discussed at the IEEE-MTT Symposium workshop in May 1980.

While the drawings show a single ferrite toroid, it is within the scope of the invention to provide more than one, provided that each extends the length of all the slots and cells. For example two ferrite toroids may be separated by a high dielectric center core, and enclosed by a single metal surface having slots on one side, with each toroid having its own magnetizing wire through it lengthwise.

A colleague has suggested a modified version of the antenna, in which the metal waveguide is removed and the electromagnetic energy is guided by the ferrite rod itself. Radiation in this case can be effected by a sequency of equally spaced metal strips (metal grating) placed on one surface of the ferrite rod. A periodic corrugation of this surface would have the same effect. Beam scanning can be accomplished as before by changing the magnetization of the ferrite material with the help of current pulses supported by a longitudinal wire embedded in the ferrite rod. Advantages of this design include extreme structural simplicity and elimination of metal losses.

An antenna of this type would be conceptually related to the "line scanner" antenna covered by U.S. Pat. No. 4,203,117 to Jacobs et al. While Jacobs et al uses a periodic dielectric radiating element, the new approach could be called the complementary magnetic grating antenna.

What is claimed is:

1. In a line source microwave antenna coupled to a source of RF energy and adapted to provide electronic beam scanning in a plane including the line source by means of an electronic driver circuit, the improvement comprising:

a longitudinal section of rectangular waveguide microwave transmission line having broad and narrow side walls enclosing a central area and including a lengthwise array of radiation means periodically located in one side wall of said waveguide section;

a hollow rectangular monolithic ferrite phase shifter located within said waveguide section extending continuously for the length of all of said radiation means of said array and including phase shifter control means coupled to said driver circuit for controlling the operative state of said ferrite phase shifter in response to output signals from said driver circuit and thereby effect scanning a beam of RF energy radiated from said array of radiation means; and said waveguide section having internal transverse cross-sectional height and width dimensions of said central area fitting closely about and substantially equal to the external transverse cross-sectional height and width dimensions of said ferrite phase shifter.

2. The antenna as defined by claim 1 wherein said array of radiation means comprises a plurality of mutually parallel angulated slots in one narrow side wall.

3. The antenna as defined by claim 1 wherein said array of radiation means comprises a plurality of mutually parallel shunt radiation means in one narrow side wall and wherein said phase shifter comprises a non-reciprocal latching ferrite phase shifter.

4. The antenna as defined by claim 3 and additionally including matching transformer means on either end of said phase shifter.

5. The antenna as defined by claim 4 wherein said phase shifter is a ferrite element including dielectric loading means located interiorally thereof.

6. The antenna as defined by claim 5 wherein said transformer means includes two dielectric elements respectively located on opposite ends of said ferrite element.

7. The antenna as defined by claim 6 wherein said dielectric loading means is a solid rectangular member centrally located within said ferrite element and coextensive therewith, said ferrite element and said dielectric loading means filling substantially the entire central area of said waveguide.

8. The microwave antenna as defined by claim 7 wherein said dielectric elements of said transformer means define generally rectangular solids of like configuration.

9. The antenna as defined by claim 1 wherein said phase shifter control means includes an electrical switching conductor coupled to said driver circuit, said conductor passing through the length of said ferrite phase shifter.

10. The antenna as defined by claim 1, wherein said waveguide microwave transmission line includes a metal coating forming said broad and narrow side walls enclosing said ferrite phase shifter, and said radiation means comprises slots in said metal coating on one side wall.

11. A scannable antenna comprising:

a section of waveguide;

a plurality of radiating means formed as a linear array along the length of said waveguide;

said waveguide including a continuous toroidal ferrite phase shifter of the same shape as said waveguide extending the length of said array and being closely positioned to said radiating means, the entire outer perimeter of the cross-section of said ferrite phase shifter fitting closely within and being substantially equal to the inner perimeter of the cross-section of said waveguide; and phase shifter control means for varying the amount of phase shift per unit length induced by said phase shifter.

12. The antenna as defined by claim 11 wherein said phase shifter includes dielectric loading means.

13. The antenna as defined by claim 11 wherein said phase shifter control means includes a conductor extending the length of said phase shifter and is enclosed by said toroidal ferrite.

* * * * *